US006936342B2

(12) United States Patent
Shibata et al.

(10) Patent No.: US 6,936,342 B2
(45) Date of Patent: Aug. 30, 2005

(54) DRIP ABSORPTION MAT

(75) Inventors: Akira Shibata, Kagawa-ken (JP); Masahiko Shikatani, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 10/068,773

(22) Filed: Feb. 5, 2002

(65) Prior Publication Data

US 2002/0187331 A1 Dec. 12, 2002

(30) Foreign Application Priority Data

Feb. 5, 2001 (JP) ..... 2001-028776
Dec. 28, 2001 (JP) ..... 2001-401377

(51) Int. Cl.[7] ..... B32B 3/26; B32B 3/10; B32B 27/14; B32B 27/12

(52) U.S. Cl. ..... 428/304.4; 428/137; 428/198; 428/317.3; 442/394

(58) Field of Search ..... 428/137, 198, 428/304.4, 317.3; 442/394

(56) References Cited

U.S. PATENT DOCUMENTS 4,551,377 A 11/1985 Elves et al. ..... 428/137
2003/0108646 A1 * 6/2003 O'Connor et al. ..... 3/392

FOREIGN PATENT DOCUMENTS

DE 291 00 596 U1 3/2001 ..... B65D/81/26
EP 1 157 672 A1 11/2001 ..... A61F/2/00
JP A-H09-86569 3/1997 ..... B65D/81/26

OTHER PUBLICATIONS

Derwent Abstract of JP 2000025869A.*
Computer translation of JP 06–305027.*
Computer translation of JP 2001–009954.*
Excerpt from JP–A–H03–85886, Aug. 30, 1991.

* cited by examiner

*Primary Examiner*—Terrel Morris
*Assistant Examiner*—Victor S Chang

(57) ABSTRACT

A drip absorption mat is provided, which is capable of preventing the color deterioration of foods such as meats on the side in contact with said mat when foods such as meat are mounted thereon. A drip absorption mat which is laid under drip-oozing foods is composed of an absorption sheet to absorb drips and a porous surface sheet which is arranged over this absorption sheet and in contact with food, so that color deterioration of meats on the side in contact with the drip absorption mat is prevented by improving the breathability of the drip-absorption mat.

9 Claims, 9 Drawing Sheets

DRIP ABSORPTION MAT

BACKGROUND OF THE INVENTION

1. Field of the Invention

The present invention relates to a drip absorption mat laid under foods such as meat and fish which are apt to ooze drips, and more specifically to a drip absorption mat which prevents foods from color deterioration in contact with the drip absorption mat.

2. Description of Related Art

In food counters in supermarkets or the like, foods such as meat and fish in a fixed amount are separately placed in a tray, packed in a transparent wrapping film, and displayed for sale. Under such sale's conditions, foods are often left on the display shelf for a long time so that drips are apt to accumulate in the tray. It is not only spoiling the appearance of foods but also causing tire accelerated deterioration thereof. Therefore, in the tray on which drip-oozing foods such as meat and fish are placed is usually underlied a tray mat to absorb drips.

Appropriately cut non-woven fabric may be used as such a type of tray mat. However, in a tray mat comprising only a single layer of non-woven fabric, absorbed drips can be totally seen from the tray mat surface, spoiling the appearance of foods. In addition, since drips absorbed are in a state wherein they are directly in contact with foods, a tray mat of this type is not so effective in retarding the food deterioration.

Therefore, to solve these problems, there has been proposed a type of tray mat comprising a non-woven fabric with a film having apertures pasted thereon. Tray mate of such type have been disclosed, for example, in Japanese Utility Model Application Laid-open No. Hei 3-85886 and Japanese Patent Application Laid-open No. Hei 9-86569. In such a tray mat, an opaque porous plastic sheet provided with numerous three-dimensional apertures is pasted on the surface of a liquid absorptive absorption sheet. According to the tray mat disclosed in these official gazettes, as the surface of absorption sheet is covered with a sheet provided with numerous apertures, drips absorbed into the absorption sheet are separated from foods so as not to be left also on the surface of tray mat. Accordingly, foods placed on the tray look good, and are protected from the progressive deterioration caused by drips.

However, in a tray mat described in the aforementioned official gazettes, the color deterioration of foods in contact with the mat has not been much taken into consideration. In the case where such a tray mat is used, there has been raised new problem that food browning (color deterioration of food) is in progress at the portion in contact with the tray mat (that is, the rear portion of foods). Even though the food browning occurs on the side invisible from outside, it results in giving consumers who have bought that food an unfavorable impression on the quality of said food.

In this regard, according to the research by the present inventors, the color change of foods is caused by the alteration of myoglobin contained meats, etc.

That is, the color of meat such a beef and fish meat such as tuna is altered depending on the type and ratio of myoglobin derivatives present therein. Herein, as types of myoglobin derivatives, there exist the reduced type myoglobin, oxymyoglobin and metmyoglobin. The reduced type myoglobin is purple red, oxymyoglobin is scarlet, and metmyoglobin is brown. Freshness impression is given to consumers in the decreasing order of scarlet>purple red>brown.

In this regard, the meat immediately after excision (cut in slices) contains almost nothing but the reduced type myoglobin, appearing purple red. When this meat is left in the atmosphere, the reduced type myoglobin is coordinated with an oxygen molecule to form oxymyoglobin so that the meat appears scarlet. When further left in the atmosphere, oyxmyoglobin is oxidized to form metmyoglobin, so that the meat turns to brown.

Herein, color deterioration of meats is caused by meat browning due to the formation of metmyoglobin as described above, which formation is accelerated by effects of oxygen partial pressure, temperature, humidity, pH, salt concentration, and light, etc.

However, present inventors' researches have revealed that, in comparison of the case where metmyoglobin is formed from the reduced type myoglobin via oxymyoglobin (reduced form myoglobin→oxymyoglobin→metmyoglobin) and the case where metmyoglobin is directly formed from the reduced type myoglobin not through oxymyoglobin (reduced form myoglobin→metmyoglobin), the former case retards the meat color deterioration due to the formation of metmyoglobin and that alteration process as in the former case can be secured by sufficient breathability provided in the drip absorption mat laid under meats.

SUMMARY OF THE INVENTION

The present invention has been made in view of the above-described situations, aiming at providing a drip absorption mat capable of preventing foods (meats) from color deterioration on the side of foods such as meats in contact with said drip absorption mat when they are mounted thereon.

A drip absorption mat according to the first invention of this application is a drip absorption mat to be placed under drip-oozing foods comprising an absorption sheet to absorb said drips and a porous surface sheet arranged over said absorption sheet and in contact with foods, and so composed that it prevents the color deterioration on the rear side of foods in contact with said porous surface sheet by adjusting the breathability of said absorption sheet in both the horizontal and/or depth directions.

With such a composition, a drip absorption mat is provided with an excellent breathability by adjusting breathability in its horizontal direction and/or depth direction so as to able to retard color deterioration of foods such as meats due to the metomyoglobin formation, thereby prevent foods such as meats on the side in contact with mats from color deterioration.

Thus, a drip absorption mat is obtained which is capable of preventing color deterioration of foods (meats) on the side in contact with the mat when foods such as meats are mounted thereon. Thus, a drip absorption mat according to this invention can be defined as a drip absorption mat for preventing foods (especially foods such as meats containing myoglobin) from color deterioration on the rear side of foods mounted thereon.

And, a drip absorption mat according to the second invention of this application is a drip absorption mat laid under drip-oozing foods comprised of a drip absorption sheet to absorb drips and a porous surface sheet arranged over said absorption sheet and in contact with foods, and so composed that the air-flow resistance (ventilation resistance) value of said drip absorption mat itself in the direction of its thickness is less than 1.00 Kpa·s/m.

With such a composition, in addition to achievement of functions and effects of the first invention, breathability of drip absorption mat itself is remarkably improved because of its air-flow resistance (ventilation resistance) in the direction of its thickness being adjusted to less than 1.00 Kpa·s/m, so that the color deterioration of foods such as meats on the side in contact with the mat can be effectively prevented.

And a drip-absorption mat according to the third invention of this application is so composed that, in the drip-absorption mat according to the second invention, the air-flow resistance (ventilation resistance) of said porous surface sheet in the direction of its thickness is less than 0.20 Kpa·s/m.

With such a composition, breathability of said porous surface sheet is noticeably improved because of its air-flow resistance value in the direction of its thickness being reduced to less than 0.20 Kpa·s/m, so that foods such as meats can be more effectively prevented from color deterioration on the side in contact with the mat.

And a drip absorption mat according to the forth invention of this application is so composed that, in the drip absorption mat according to the second or third invention, the air-flow resistance (ventilation resistance) in the horizontal direction of the drip absorption mat itself is adjusted to less than 0.20 Kpa·s/m when measured by the following test method:

A plurality of drip absorption mats are laid with one on top of another to build a drip absorption mat stack, from which a cylinder of 28 mm in diameter and 5.0 mm thick is excised in the direction of layering, and said cylindrically excised drip absorption mat stack is aerated in the horizontal direction of the drip absorption mat itself.

With such a construction, since the air-flow resistance value in the horizontal direction of the drip absorption mat itself is adjusted to a favorable breathability such as less than 0.20 Kpa·s/m when measured by the test method as described above, the excellent breathability is secured both in the direction of thickness and in the horizontal direction of the drip absorption mat itself to improve the breathability of said porous surface sheet, so that the color deterioration of foods such as meat on the side in contact with the mat can be effectively prevented.

Further, in a drip absorption mat according to the fifth invention of this application, said absorption sheet in the drip absorption mat according to any of the second through the forth inventions is composed of a non-woven fabric of 0.3 mm to 3.0 mm in thickness.

With such a composition, in addition to achievement of functions and effects in any of the second through the forth inventions, because of the absorption sheet being 0.3 mm to 3.0 mm thick, not only the drip absorption by said absorption sheet can be effectively performed but also bulkiness of the absorption mat can be avoided.

That is, when said absorption sheet is less than 0.3 mm thick, the drip absorbing capability thereof becomes insufficient, while, when the thickness exceeds 3.0 mm, the mat becomes bulky so as to become inconvenient for handling. However, these problems are effectively solved in this invention so that a drip absorption mat capable of preventing the color deterioration of foods can be obtained.

Furthermore, a drip-absorption mat according to the sixth invention of this application is a drip absorption mat to be laid under drip-oozing foods comprising said absorption sheet to absorb drips and a porous surface sheet which is arranged on the upper side of said absorption sheet and in contact with foods, wherein said porous surface sheet is composed of a film with convex and concavity shaped minute undulations, wherein a hollow cavity is formed inside each of these convex portions, while each of said concavities is provided with a pore to form a minute aperture.

With such a composition, in addition to achievement of functions and effects in any of the above-described inventions, because of a minute aperture formed by providing a pore at the bottom of concavity of the film having minute undulations while a hollow is formed within the convex of said film the air inside the space within the convex portion can readily penetrate into the inside of the aperture (concavity) via the absorption sheet. And, the air inside the convex portions thus allowed to easily penetrate into the inside of apertures (concavities) induces a free traffic of air via the inside spaces of these convex portions. As a result, breathability becomes noticeably improved compared with the case where air reaches the inside of aperture by penetrating through the absorption sheet, so that foods such as meats be effectively prevented from color deterioration.

Furthermore, a drip absorption mat according to the seventh invention of this application is so composed that, in the drip absorption mat according to the sixth invention, the end portions of the above-described porous surface sheet in contact with said absorption mat are notched so as to facilitate the easy air flow from the horizontal direction. Herein, "horizontal direction" means, for example in FIG. 11(B) and FIG. 12, directions such as the one from the hollow 13*c* to the outside of the minute aperture 13*a*, or the one from the outside of the minute aperture 13*a* into the hollow 13*c*.

Such a composition provides the excellent breathability both in the horizontal direction and the thickness (depth) direction of the drip absorption mat. That is, even in the case where a drip absorption mat according to the seventh invention is used as a tray mat to lay dripping foods such as meat and fish thereon, air is sufficiently supplied to the bottom surface of food in contact with the tray mat because of the excellent breathability provided in both horizontal and depth directions, so that the color deterioration in portions of the bottom surface of foods in contact with the tray mat can be prevented especially when food is meat.

And, a drip absorption mat according to the eighth invention of this application is so composed that said apertures in the drip absorption mat according to the sixth or seventh invention are tapered with the diameter thereof on the side in contact with foods being enlarged.

With such a composition, said aperture is in the form of a so-called funnel toward foods, so that drips are readily guided to the drip absorption mat side through this aperture.

And, a drip-absorbing mat according to the ninth invention of this application is so composed that, in a drip absorption mat according to any of the sixth through the eighth inventions, said absorption sheet and said porous surface sheet are adhered with each other so as not to clog said apertures provided on said porous surface sheet.

With such a composition, said absorption sheet and said porous surface sheet are hardly separated so that the handling thereof such as transportation, etc, of drip absorption mats becomes easy.

Furthermore, a drip absorption mat according to the tenth invention of this application is so composed that, in the drip absorption mat according to the ninth invention, said adhesion sites are dotty or linear.

With such a composition, a drip absorption mat easy to handle can be obtained with the adhesion area being minimized as much as possible without damaging features of the absorption sheet and porous surface sheet.

Moreover, a drip absorption mat according to the eleventh invention of this application is so composed that, in the drip absorption mat according to any of the sixth through the tenth inventions, said film with fine undulations comprising said porous surface sheet shares less than 30% of the space occupied by said porous surface sheet as a whole.

With such a composition, a space with the film being absent is increased to exceed a predetermined level in the space occupied by said porous surface sheet, so that the air in that space can be guided to the inside of apertures to increase the air volume to be in contact with the surface of food.

Namely, a porous surface sheet composed of said film having fine undulations in the mountain-valley shape is comprised of a film itself and spaces formed by undulations. In this invention, as the space proportion becomes more than 70%, the air volume within spaces can be increased.

Therefore, this arrangement can efficiently prevent foods (meats) from color deterioration on the side in contact with the mat.

In addition, this arrangement can not only reduce the material cost at the time of manufacturing said film but also improve the heat insulation capacity of mat owing to the air within undulations.

Further, a drip absorption mat according to the twelfth invention of this application is so composed that, in the drip absorption mat according to any of the sixth through the eleventh inventions, said apertures are present at 20 or more per 1 $cm^2$.

With such a composition, the ventilation resistance value of said porous surface sheet can be easily reduced.

Furthermore, a drip absorption mat according to the thirteenth invention of this application is so composed that, in a drip absorption mat according to any of the sixth through the twelfth inventions, the ventilation resistance value of said drip absorption mat itself is adjusted to less than 0.2 Kpa·s/m when measured by the following test method:

A plurality of drip absorption mats are laid with one on top of another to build a drip absorption mat stack, from which a cylinder of 28 mm in diameter and 5.0 mm thick is excised in the direction of layering, and said cylindrically excised drip absorption mat stack is aerated in the horizontal direction of the drip absorption mat itself.

With such a construction, since the air-flow resistance value in the horizontal direction of the drip absorption mat itself is adjusted to a favorable breathability such as less than 0.20 Kpa·s/m when measured by the test method as described above, the excellent breathability is secured in both the depth and surface directions thereof to remarkably improve the breathability of said porous surface sheet, so that the color deterioration of foods such as meat on the side in contact with the mat can be effectively prevented.

Furthermore, a drip absorption mat according to the fourteenth invention of this application is so composed that, in a drip absorption mat according to any of the first through the thirteenth inventions, said drip absorption mat is a tray mat which is laid on the loading surface of a tray on which dripping foods are laid.

With such a composition, color deterioration on the rear side of foods (meats) placed on a tray can be prevented.

BRIEF DESCRIPTION OF THE DRAWINGS

FIG. 11 is a schematic diagram for describing an excellent breathability state maintained by the drip absorption mat according to a preferred embodiment of this invention, wherein FIG. 11(A) represents a schematic diagram showing the functional composition of the tray mat according to the conventional technique (Japanese Patent Application Laid-open No. Hei9-86569), and FIG. 11(B) represents a schematic diagram showing the functional composition of the drip absorption mat according to the present embodiment.

DETAILED DESCRIPTION OF THE PREFERRED EMBODIMENT

Figure 1:
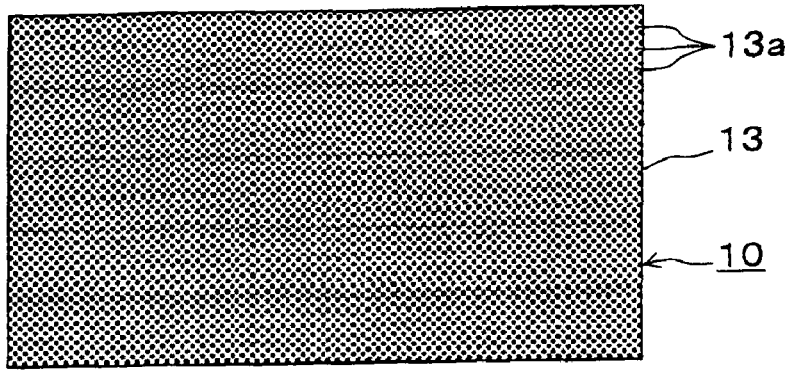
FIG. 1 is a schematic diagram showing the composition of a tray mat according to this embodiment, representing a plan view of said tray mat according to this embodiment.
Figure 2:
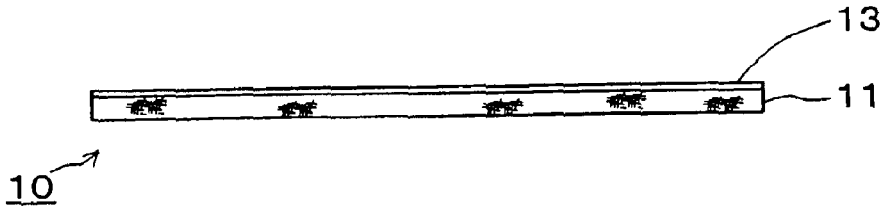
FIG. 2 is a schematic diagram showing the composition of the tray mat according to this embodiment, representing a side view of said tray mat according to this embodiment.
Figure 3:
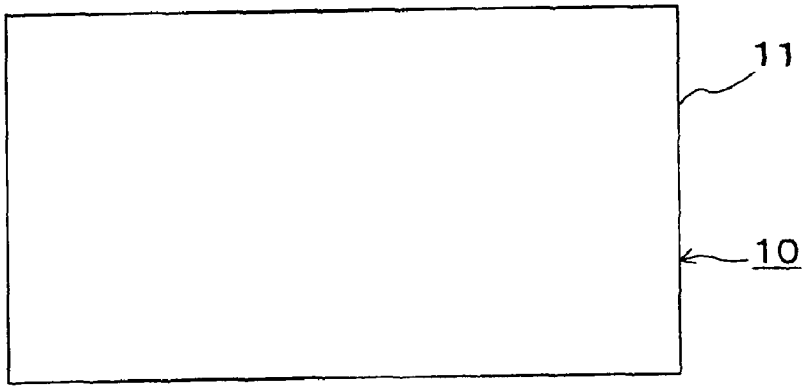
FIG. 3 is a schematic diagram showing the composition of the tray mat according to this embodiment, representing a top plan view of an absorption sheet of said tray mat according to this embodiment.
Figure 4:
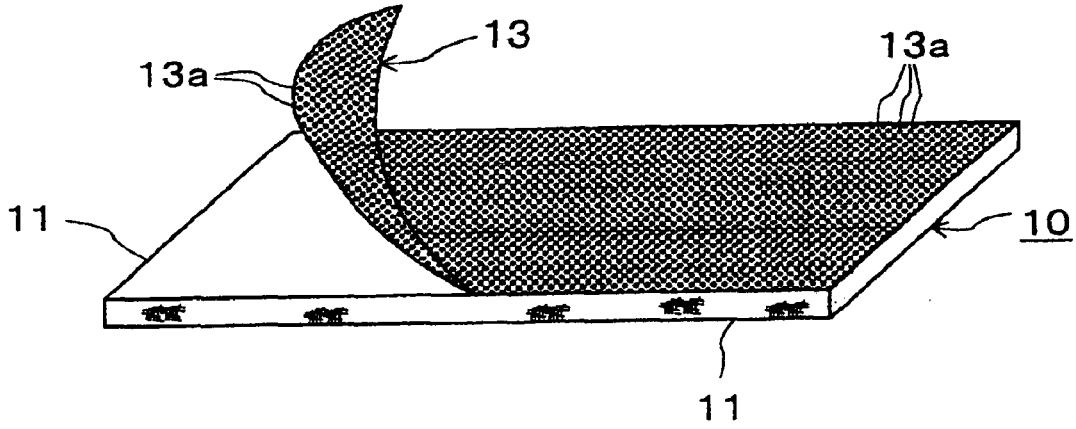
FIG. 4 is a schematic diagram showing the composition of the tray mat according to this embodiment, representing a perspective view of said tray mat according to this embodiment, the surface sheet of which is partially peeled.

In the following, one preferred embodiment of a drip absorption mat according to this invention used as a tray mat will be described with reference to the drawings. First, FIGS. 1~4 are schematic diagrams showing the composition of a tray mat according to this embodiment: FIG. 1 is a plan view, FIG. 2 is a side view, FIG. 3 is a top plan view of an absorption sheet, and FIG. 4 is a perspective view of a partially peeled porous surface sheet.

As shown in FIGS. 1, 2 and 4, a tray mat 10 according to this embodiment is composed of the liquid-absorptive absorption sheet 11 laminated by the porous surface sheet 13.

In this embodiment, the liquid-absorptive absorption sheet 11 is composed of a non-woven fabric, and capable of absorbing drips oozing from foods. On the other hand, the surface sheet 13 is made of a porous resin film. With such a tray mat 10 according to this embodiment, drips oozing out from foods are absorbed by the absorption sheet 11 through apertures 13*a* of the surface sheet 13. In this case, as the surface sheet 13 is in contact with meat only in little surface area, drips are not retained on the surface thereof so that meat placed on the tray mat 10 becomes completely separated from drips, thereby the progression of deterioration of foods caused by drips can be prevented.

In the tray mat 10 according to this embodiment, the ventilation resistance value of the tray mat 10 itself is set to be less than 1.00 Kpa·s/m by adjusting the size and density of apertures 13*a* on the porous surface sheet 13, and the thickness of the absorption sheet 11. Therefore, when the tray mat 10 according to this embodiment is used, due to the excellent breathability thereof, the reduced myoglobin contained in the meat placed on said tray mat is to convert to metmyoglobin via oxymyoglobin so as to retard the meat browning caused by the formation of metmyoglobin. As a result, the progression in meat browning on the site in contract with the tray mat can be sufficiently suppressed.

Herein, to secure such an excellent breathability as described above, in the tray mat 10 according to this embodiment, the ventilation resistance value of the surface sheet 13 is set to be less than 0.20 Kpa·s/m. Furthermore, the thickness of the absorption sheet 11 formed from non-woven fabric is adjusted to be in the range of 0.3 mm to 3.0 mm, preferably 0.5 mm to 2.0 mm, more preferably 0.75 mm to 1.5 mm. In addition, in the tray mat 10 according to this embodiment, to secure the excellent breathability; the surface sheet 13 is so composed that the density of apertures 13*a* becomes more than 20/cm$^2$, and that it adheres to the absorption sheet 11 through the intermediary of the adhering parts 14 scattered on the whole surface of the absorption sheet 11. In this embodiment, adhesion at the adhesion parts 14 is cared out with a hot melt adhesive.

FIGS. 5–9 are to describe the function of tray mat 10 according to this embodiment in more detail.

Figure 5:
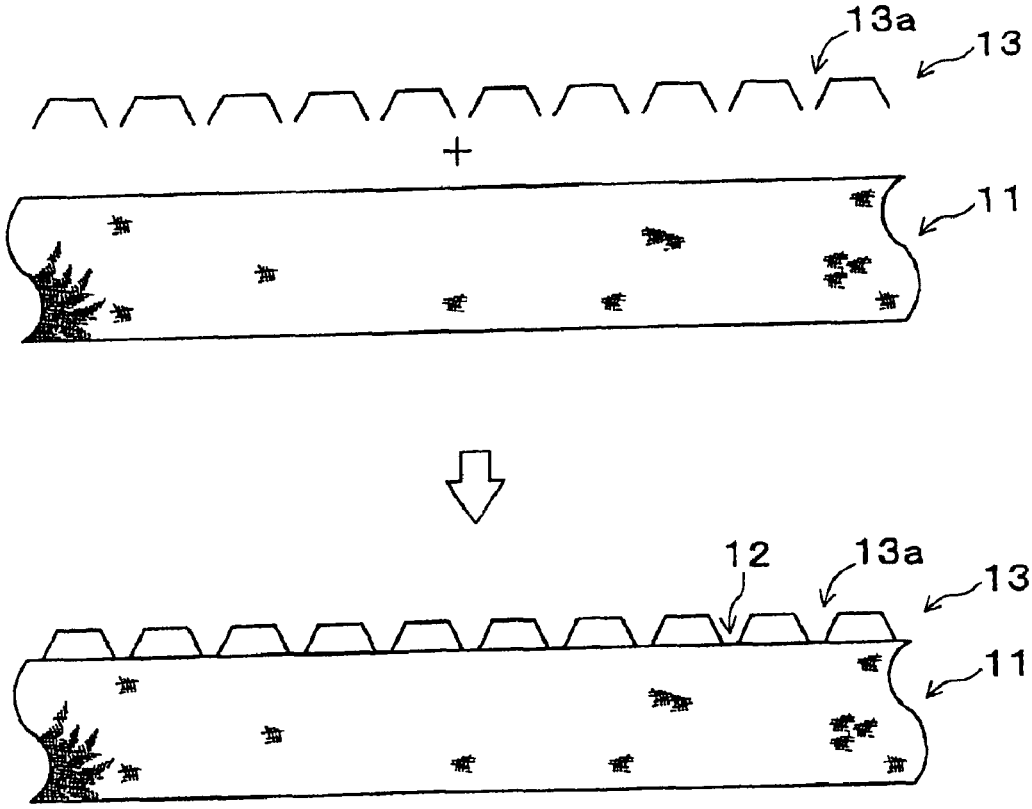
FIG. 5 is a schematic diagram for describing the function of the tray mat according to this embodiment in more detail, representing one process of manufacturing the tray mat by adhering an absorption sheet and a surface sheet.

First, as shown in FIG. 5, the tray mat 10 according to this embodiment is formed by a partial adhesion of the porous surface sheet 13 provided with apertures 13*a* to the absorption sheet 11. In such a tray mat 10, the surface sheet 13 is composed of a film with fine undulations wherein minute tapered apertures 13*a* are formed by providing a pore 12 at the concave bottom thereof.

Figure 6:
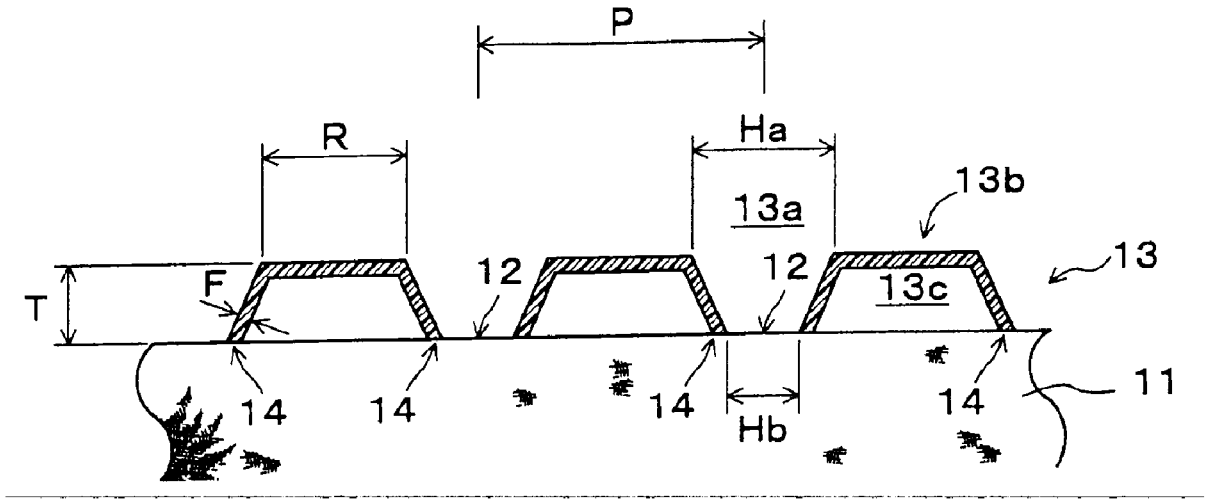
FIG. 6 is a schematic diagram for describing the function of the tray mat according to this embodiment in more detail, representing an enlarged cross section of a portion of the surface sheet.

Herein, as shown in FIG. 6, the cross section of the aperture 13*a* becomes tapered, and a hollow 13*c* is formed inside the convex (or concave) portion 13*b*. This structural arrangement facilitates the weight reduction of the tray mat 10 as a whole and at the same time enables the air in the hollow 13*c* to easily penetrate to the inside of the aperture 13*a* via the pore 12.

In this embodiment, while the thickness F of a film composing the surface sheet 13 is 0.005 mm~0.1 mm the depth T of the aperture 13*a* is 0.02 mm~1.0 mm, so that in practice this depth T is to represent the apparent thickness of the surface sheet 13, that is, 0.02 mm~1.0 mm. Furthermore, in the space occupied by the surface sheet 13 (porous surface sheet) as a whole, the share of the film is preferably less than 30%, more preferably less than 10% thereof.

In addition, in this embodiment, the rib width R between the adjacent apertures 13*a*'s is less than 1 mm, and, of the diameter of the aperture 13*a*, the aperture diameter Hb on the side in contact with the absorption sheet 11 is less than 2.0 mm, and the aperture diameter Ha on the side in contact with foods is less than 5.0 mm.

These parameters and parameters associated with them will be described in detail as follows.

First, as the surface sheet 13, a film provided with apertures is preferably used, and the aperture diameter thereof is less than 5.0 mm, more preferably in the range of 0.1~2.0 mm. In this regard, when the aperture 13*a* is too large in size, drips absorbed from the aperture part into the absorption sheet 11 undesirably become visible. On the other hand, when the aperture is too small, it becomes difficult for drips to be absorbed into the absorption sheet 11 through the aperture 13*a*.

The aperture diameter on the side in contact with foods is preferably larger than that on the side in contact with the absorption sheet 11. This arrangement not only facilitates the easy movement of drips to the absorption sheet 11 through the numerous aperture 13*a* but also prevents drips from going backwards. Furthermore, small aperture diameter prevents drips therein from being visible from the surface.

Density of apertures 13*a* is preferably more than 20/cm$^2$, more preferably more than 200/cm$^2$. The even arrangement of numerous apertures 13*a* enables meats to be evenly in contact with air.

The aperture pitch P is preferably in the range of 0.1~2.0 mm, and the rib width R is desirably in the range of 0.01~2.0 mm. In particular, the rib width is more preferably less than 1.0 mm. The narrow rib width R enables the film surface in contact with meats to be reduced, so that meats can be more evenly in contact with air.

Figure 7:
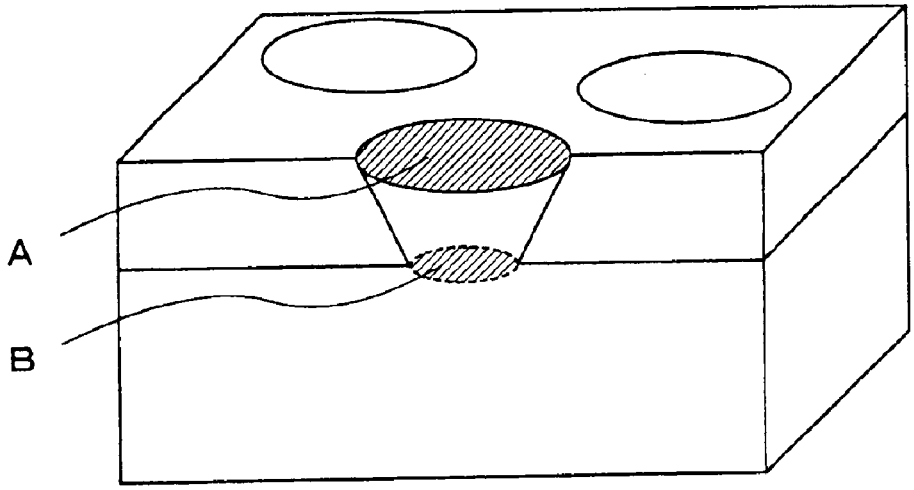
FIG. 7 is a schematic diagram for describing the function of the tray mat according to this embodiment in more detail, representing an enlarged perspective view for depicting the shape of an aperture in the surface sheet.
Figure 8:
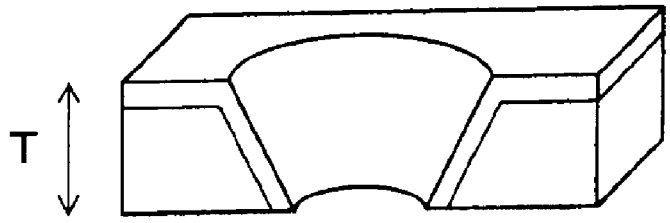
FIG. 8 is a schematic diagram for describing the function of the tray mat according to this embodiment in more detail, representing an enlarged perspective view of an aperture, a part of which is scraped off to depict the shape of the aperture in the surface sheet.
Figure 9:
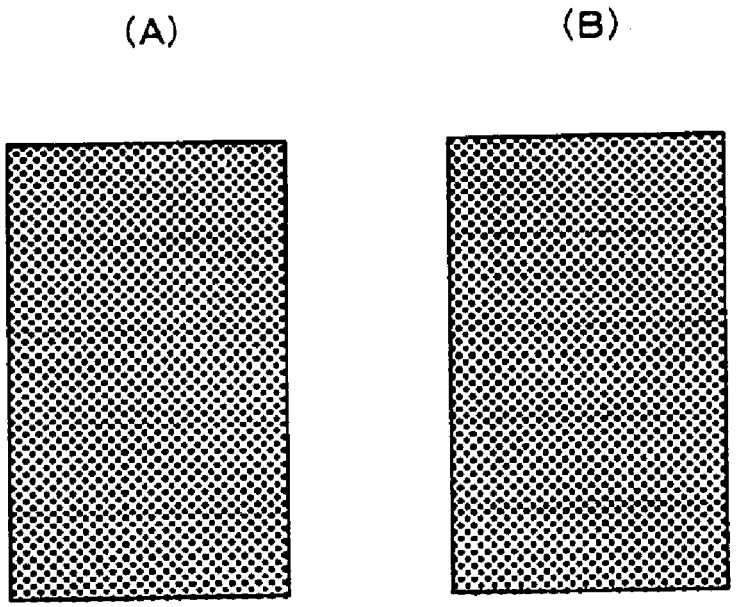
FIG. 9 is a schematic diagram for describing the function of the tray mat according to this embodiment in more detail, representing a front view of a non-adhered surface sheet (FIG. 9(A)) and a rear view thereof (FIG. 9(B)).

The aperture area ratio on the side in contact with foods is in the range of 30~99%, preferably. 50~90%, and more preferably 60~80%, and that on the side in contact with the absorption sheet 11 is in the range of 1~60% and preferably 15~22%. In this case, as shown in FIG. 7, the aperture area ratio on the side in contact with foods is associated with a large aperture A (aperture diameter Ha), representing the "apparent aperture area ratio" in the case of overlooking the tray mat 10(FIG. 9(A)). On the other hand, the aperture area ratio on the side in contact with the absorption mat 11 is associated with a small aperture B (aperture diameter Hb), representing the "substantive aperture area ratio" (FIG. 9(B)). In this invention, the "substantive aperture area ratio" is set smaller than the "apparent aperture area ratio" (cf. FIGS. 9(A) and 9(B)).

That is, the drip absorption mat according to the preferred embodiment of this invention is so arranged that the aperture formed on the side in contact with the absorption sheet 11 is smaller in size than that formed on the side in contact with foods. Thus, the area of the tray mat in contact with meats becomes relatively small while the area of meats in contact with air becomes large, so that the color deterioration on the rear side of meats in contact with the mat is prevented in conjunction with the improved aeration.

In addition to the above-described construction, the drip absorption mat according to a preferred embodiment of this invention is arranged so as to improve breathability in the horizontal direction thereon as described below.

Figure 10:
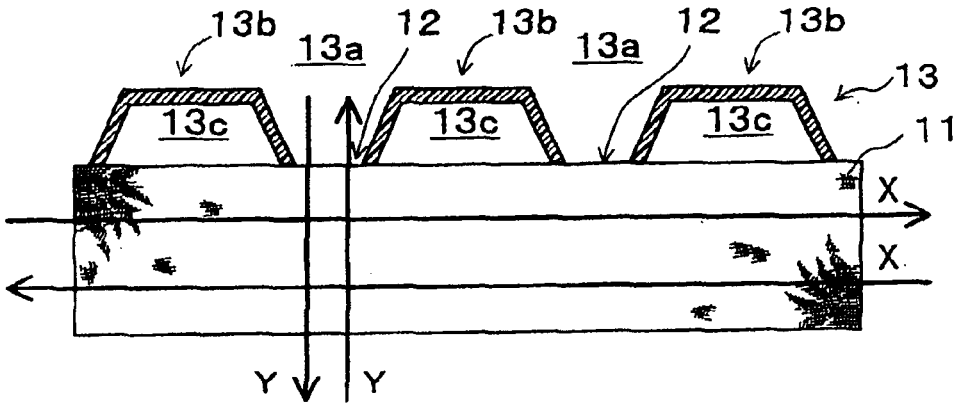
FIG. 10 is a schematic diagram showing the vertical section of the drip absorption mat according to a preferred embodiment of this invention.

First, FIG. 10 is a schematic diagram showing the vertical section of a drip absorption mat according to a preferred embodiment of this invention, wherein like components shown in FIG. 6 are represented by like numerals with explanations thereof being omitted.

As shown in FIG. 10, the drip absorption mat according to a preferred embodiment of this invention is so composed that the breathability thereof in both the horizontal direction X and thickness direction Y is excellent.

Herein, concerning the excellent breathability arranged for the drip absorption mat according to this embodiment, the breathability of the absorption sheet 11 is controlled by adjusting the quality of material, density, thickness or mesh (metsuke), etc. Furthermore, some devices have been also made to structurally improve breathability, which will be described below.

Figure 11:
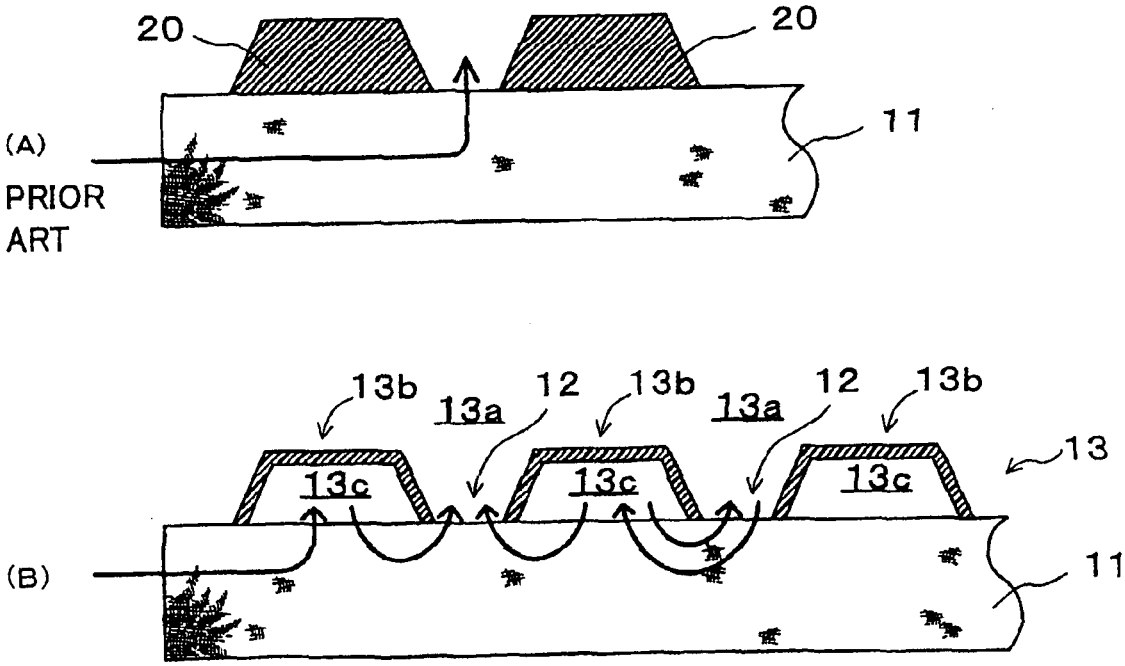

First, in a tray mat according to a conventional technique (Japanese Patent application Laid-open No. Hei 9-86569) shown in FIG. 11A, the composition material 20 of a network (corresponding to the surface sheet 13 in this embodiment) put on the surface of a tray mat is of a bulky body so that the air penetrating from the horizontal direction of the absorption sheet 11 is to pass through under the bulky network composition material 20, as shown by the solid arrow in this figure, and flow out from mesh portions (corresponding to the aperture 13*a* in this embodiment) of the network.

In contrast, in the drip absorption mat according to this embodiment, as shown by a solid arrow in FIG. 11(B), the air penetrating from the horizontal direction of the absorption sheet 11 is to pass through the hollow cavity 13*c* formed inside the convex 13*b*, and flow away from the aperture 13*a* of the surface sheet 13.

As evident from comparing the air passages shown in FIGS. 11(A) and 11(B), conventional technique is inferior in the breathability as much as a long distance in the absorption sheet 11 through which air passes. Thus, in the drip absorption mat according to this embodiment, the porous race sheet 13 is composed of a film having minute undulations, wherein a hollow cavity 13*c* is formed inside this convex portion 13*b* while minute pores 12 are provided at the bottom of the concavity so as to improve the breathability in the horizontal direction.

Figure 12:
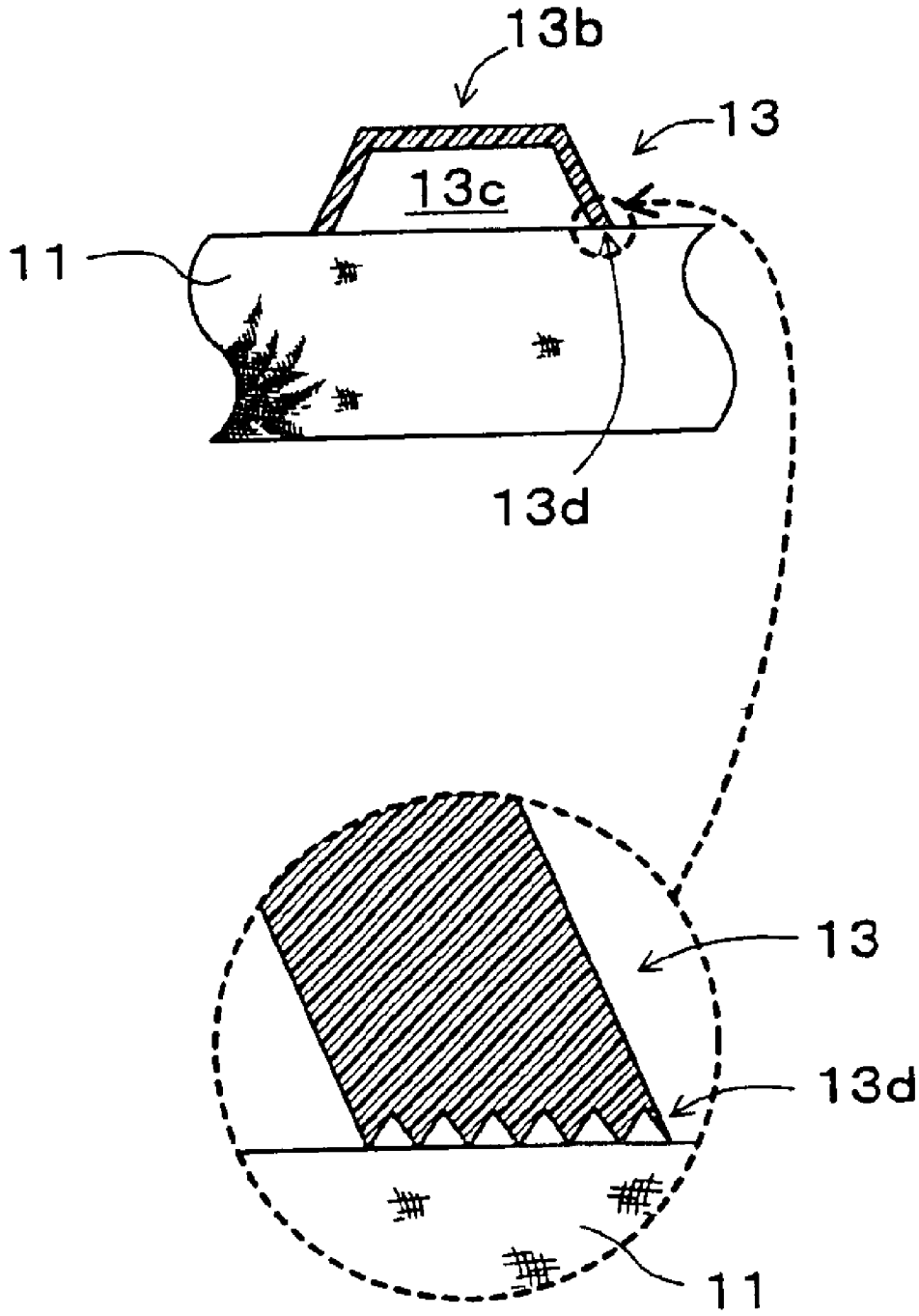
FIG. 12 is a schematic diagram showing the shape of the terminal portion 13*d* in contact with the absorption sheet 11 and the surface sheet 13, and the portion surrounded by dotted line represents the enlarged view of the corresponding section.
Figure 13:
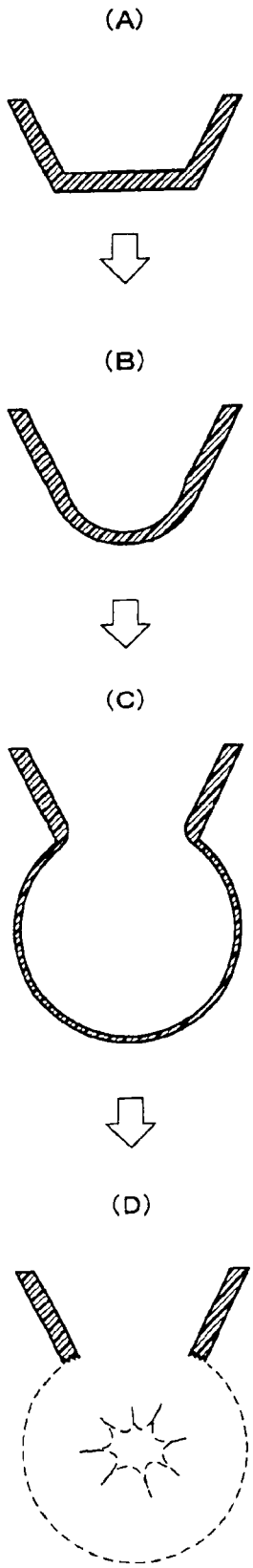
FIG. 13 is a flow chart showing an example of a method for forming the notched terminal end 13*d*.

Furthermore, in the drip absorption mat according to the present embodiment, as shown in FIG. 12, the surface sheet 13 is intentionally notched at the terminal portion 13*d* in contact with the absorption sheet 11 so as to facilitate the air flow from the horizontal direction (from the hollow cavity 13*c* to the outside of minute apertures 13*a*, or from the outside of minute apertures 13*a* to the hollow cavity 13*c*). Such a shaped body with notched edge 13*d* can be formed, as shown in FIG. 13, after molding a stand-shaped body (A) by the blow molding, etc., by gradually swelling out the bottom portion thereof with heat (processes (B)→(C)), and finally blowing it out (D).

In this case, while the breathability of the drip absorption mat itself in the horizontal direction can be controlled, in addition to the above-described structural devices, by adjusting the quality of material, density, thickness, or mesh (metsuke) etc., whether breathability is excellent or not is confirmed by the following test method, and, in the drip absorption mat according to the present embodiment, the ventilation resistance value of the drip absorption mat itself in the horizontal direction is adjusted to less than 0.2 Kpa·s/m when measured by the following test method.

Figure 14:
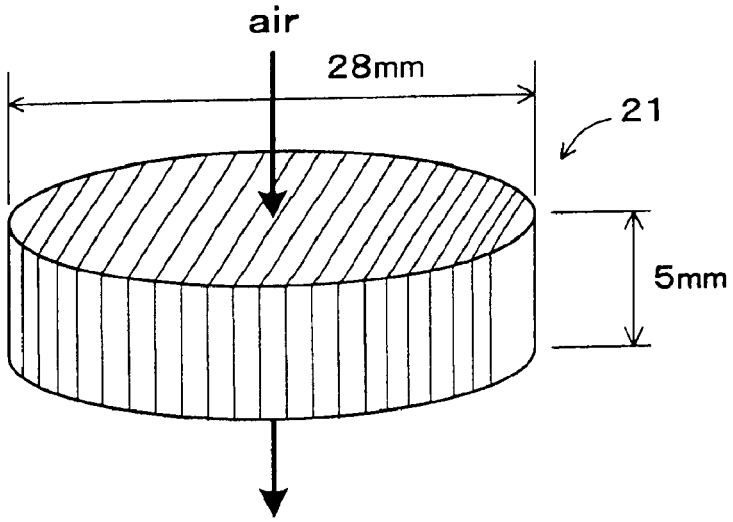
FIG. 14 is a schematic diagram for describing a test method for measuring the ventilation resistance value of the drip absorption mat according to an embodiment of this invention.

First, a plurality of drip absorption mats are laid with one on top of another to build a drip absorption mat stack 21, from which a cylinder of 28 mm in diameter and 5.0 mm thick in the direction of layering is excised as represented in FIG. 14. Said cylindrically excised drip absorption mat stack 21 is subjected to the breathability measurement by aerating in the horizontal direction of the drip absorption mat itself.

Figure 15:
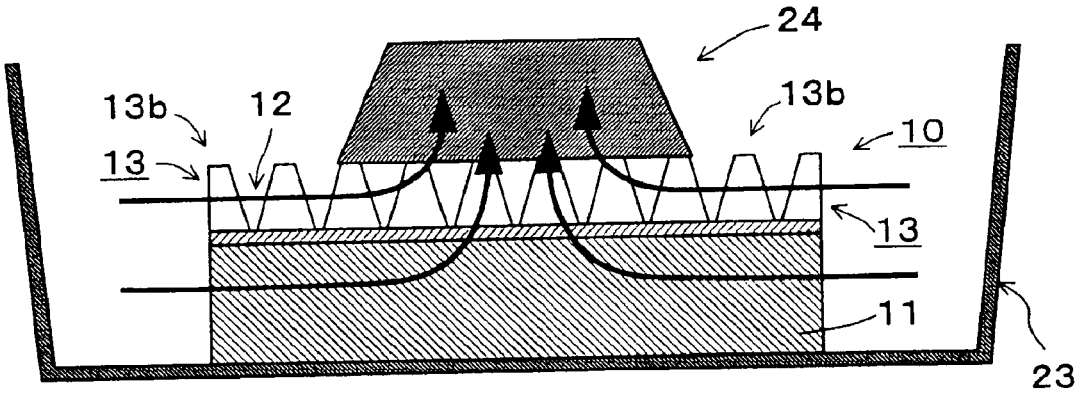
FIG. 15 is a schematic diagram showing a state wherein the drip absorption mat according to the present embodiment is used as a tray mat.

Thus, as shown in FIG. 15, even in the case where the drip absorption mat according to the present embodiment is used as the tray mat 10 to be laid upon the tray 23 as the tray mat 10, and foods oozing drips such as meat or fish 24 are placed thereon, owing to the excellent breathability arranged in the horizontal direction, sufficient air is supplied to the bottom portions of the food 24 in contact with the tray mat 10 so that color deterioration at the bottom portions of the food 24 in contact with the tray mat 10 is to be prevented in such a case where food 24 is meat.

Herein, the resin composition of the film can be suitably selected from a group comprising synthetic resins of the polyolefine type such as polyethylene and polyproplylene, the polyethylene type, and filler resins. To these resins may be added activators and pigments. For example, mixing of $TiO_2$ into resins makes the film opaque to improve the concealing ability thereof so that absorbed drips become hardly recognizable from the surface side.

Materials composing the absorption sheet 11 can be suitably selected from a group comprising non-woven fabrics such as air-laid non-woven fabric and thermal bond non-woven fabric, paper and urethane, etc. Specifically, the absorption sheet 11 can be composed of, in addition to materials shown in the above-described embodiment, a bulky air-laid non-woven fabric having mesh (metsuke) 60 $g/m^2$ and the thickness of 1.1 mm. The mesh (metsuke) and thickness of a fabric to be used may be determined in the range of the ventilation resistance value of less than 1.00 Kpa·g/m in which the tray mat 10 has to be provided, so that drips oozing out from foods can be satisfactorily absorbed. As to the air-laid pulp, the mesh (metauske) thereof is preferably in the range of 10~120 $g/m^2$ and its thickness in the range of 0.3~3 mm, more preferably 0.5~2 mm.

The surface sheet 13 and absorption sheet 11 can be adhered at areas 14 using methods suitably selectable by those skilled in the art such as the adhesion with adhesives, thermal adhesion, or sonic adhesion, etc. In order not to rain the absorption capability and breathability of the tray mat 10, the adhesion 14 must be performed so as not dog the aperture 13*a* on the surface sheet 13, the aperture 12 in particular (that is, the aperture B in FIG. 7) opened on the side in contact with the absorption sheet 11 (on the side in direct contact with the absorption sheet 11) without altering the substantive ratio of aperture areas prior to and after the adhesion. Specifically, the surface sheet 13 and absorption sheet 11 are adhered by spraying a hot melt adhesive at 3.0 $g/m^2$. In this case, the hot melt adhesive may be arranged to be sprayed in less than 0.3 mm wide so as to avoid the complete clogging of the apertures 12 on the absorption 11 side of the surface sheet 13.

The drip absorption mat according to this invention is not limited to the use as tray mat, and can be used as a drip absorption mat in general to be placed under foods apt to ooze drips.

Meat Coloring Test

Immediately after teat sample pieces were excised from the identical chunk of meat, coloring levels "a" thereof were measured. Next, test meat sample pieces were placed on the respective tray mats 10's, and the coloring levels "a" thereof on the surface side in contact with the tray mat 10 were measured 5, 24, 48, 96 and 144 hours later.

In this case, the coloring level "a" was determined using a color difference meter (Minolta, trade name "CR-300") in accordance with the "D-O" method as defined in JIS Z8722. At the measurement, a sample to be measured was irradiated from every direction so that only the reflecting light in the direction perpendicular to the sample to be measured was received. The measuring diameter was 8.0 mm, and a value of coloring level "a" in the direction from red to green was used.

Ventilation resistance values of films having the aperture area ratios shown in Table 1 were measured in each of experiments 1~4, and comparative examples 1 and 2. Respective films were used as surface sheet 13*s* of the tray mat 10, and the color degradation of meats were measured. The results are shown in the same table 1.

The ventilation resistance value was measured using the Automatic Air-Permeability Tester (KatoTek, trade name "KES-F8-AP1"), wherein the tray mat 10 or surface sheet 13 was ventilated constantly with air at the flow rate of 4 cc/cm$^2$ sec (area=$2\times10^{-4}$ m$^2$), and then air was released and sucked out. Then, the pressure loss for the 3-sec exhaustion and 3-sec suction was measured using a semiconductor pressure difference gauge to obtain the integral value.

a porous surface sheet adjoining the absorption sheet, and having a first side facing the absorption sheet and a second side configured to adjoin the food;

wherein said porous surface sheet comprises a film having a plurality of protrusions, each protrusion having a convex side and a concave side;

wherein a hollow cavity is formed adjacent the protrusions on the convex side; and wherein a pore is provided at the bottom of said concave side of each protrusion such that the protrusion forms a minute aperture;

wherein a terminal portion of said porous surface sheet is adjacent the minute aperture and in contact with the absorption sheet; and wherein the terminal portion forms a notched edge so as to facilitate air flow between the hollow cavity and the apertures.

2. A drip absorption mat according to claim 1;

wherein said minute aperture is tapered with an opening of larger diameter on a side configured to adjoin the food.

3. A drip absorption mat according to claim 1;

wherein said absorption sheet and said porous surface sheet are adhered to each other in a manner that does not clog said minute aperture.

4. A drip absorption mat according to claim 3;

TABLE 1

| | | | aperture area ratio of surface sheet (%) | | ventilation resistance value (Kpa · s/m) | |
|---|---|---|---|---|---|---|
| | surface sheet | absorber | substantive aperture area ratio | apparent aperture area ratio | surface sheet only | absorption mat as whole |
| example 1 | porous film | air-laid pulp | 23.8% | 80.9% | 0.0080 | 0.0810 |
| example 2 | porous film | air-laid pulp | 19.4% | 67.0% | 0.0080 | 0.1090 |
| example 3 | porous film | air-laid pulp | 15.2% | 86.7% | 0.0130 | 0.1000 |
| example 4 | porous film | air-laid pulp | 19.8% | 68.6% | 0.0090 | 0.0910 |
| comparative example 1 | film having partial apertures | air-laid pulp | 1.4% | 1.6% | 0.4000 | 2.0800 |
| comparative example 2 | film having a partial cut | air-laid pulp | 0.0% | 0.0% | 25.5000 | 26.6300 |

| coloring level "a" | | | | | | |
|---|---|---|---|---|---|---|
| immediately after excision | 5 h after | 24 h after | 48 h after | 96 h after | 144 h after | good looking color after 144 h |
| 18.9 | 24.4 | 20.5 | 17.0 | 13.4 | 10.3 | ○ |
| 17.2 | 24.3 | 21.9 | 17.1 | 13.4 | 11.1 | ○ |
| 18.3 | 25.5 | 19.4 | 16.2 | 11.5 | 9.9 | ○ |
| 18.1 | 23.1 | 18.4 | 14.6 | 12.2 | 9.2 | ○ |
| 16.4 | 20.8 | 18.9 | 15.6 | 10.9 | 9.1 | X |
| 17.9 | 17.7 | 10.9 | 8.4 | 7.8 | 6.5 | X |

Figure 16:
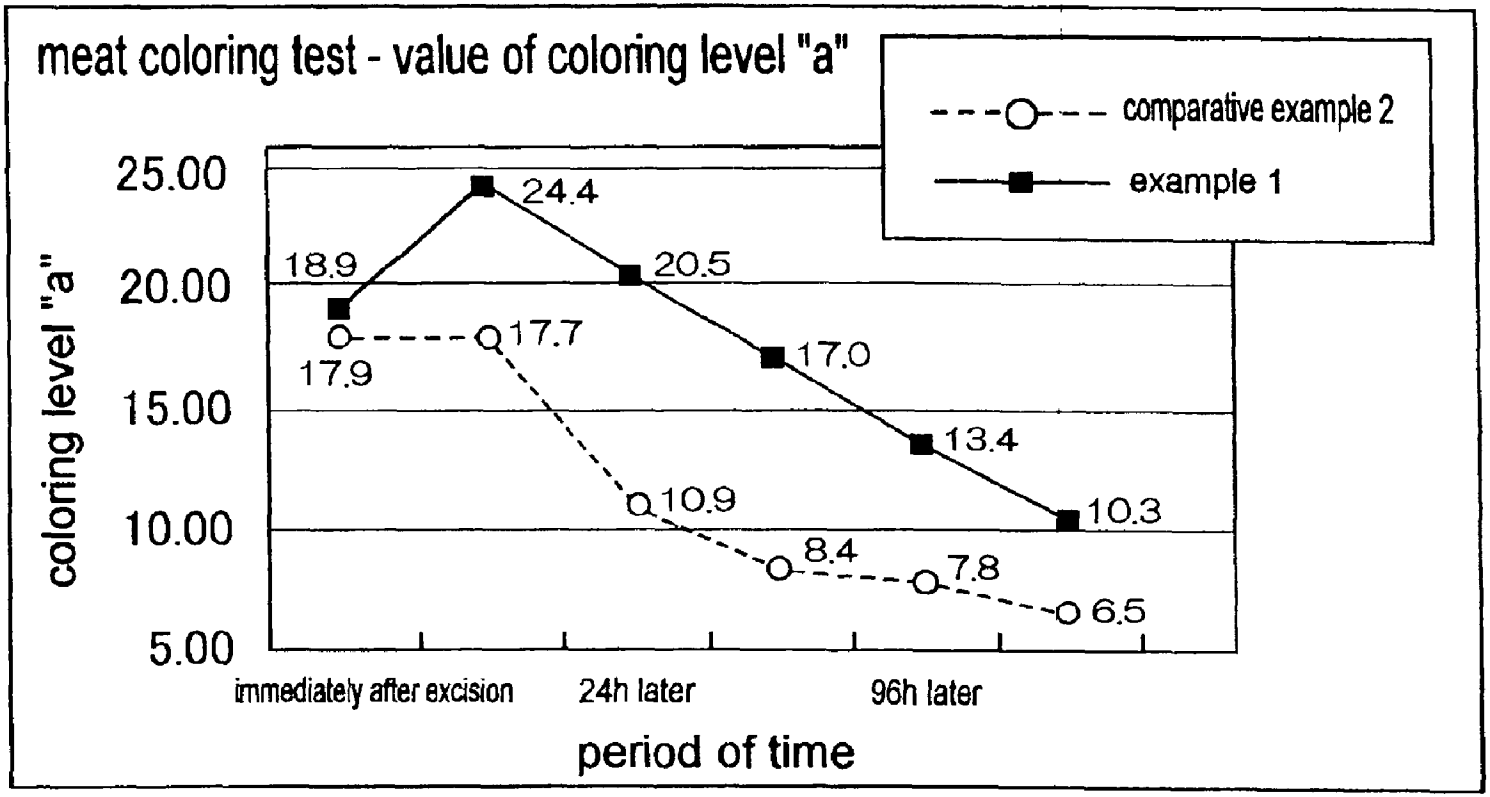
FIG. 16 is a graphic representation showing variations of coloring levels "a"in Comparative example 2 and Example 1.

Variations of the coloring level values "a" in Comparative Example 2 and Example 1 are shown in FIG. 16. As clearly understood from Table 1 and FIG. 16, an excellent coloring state of meats can be maintained relatively long in the case where the tray mat 10 according to this invention was used.

As described above, according to this invention, a drip absorption mat can, be obtained which can prevent foods such as meat from the color deterioration on the surface side in contact with said mat when foods such as meat are placed thereon.

What is claimed is:

1. A drip absorption mat to be laid under a drip-oozing food comprising:

an absorption sheet configured to absorb drips; and wherein the absorption and porous surface sheets are glued either at dots or in a line.

5. A drip absorption mat, for use with a tray configured with a mounting surface on which the food is to be placed, according to claim 4;

wherein said drip absorption mat is sized to be laid on the mounting surface of the tray between the tray and the food.

6. A drip absorption mat according to claim 1;

wherein said surface sheet defines a space occupied as a whole, said film occupying not more than 30% of the space occupied as a whole.

7. A drip absorption mat according to claim 1;

wherein the number of said apertures is riot below 20 per 1 cm$^2$.

8. A drip absorption mat according to claim 1;

wherein said drip absorption mat is characterized by a ventilation resistance value in a horizontal direction that does not exceed 0.20 Kpa·s/m when measured by a test methodology, comprising:

laying a plurality of drip absorption mats one on top of another to build a drip absorption mat stack;

excising a cylinder of 28 mm in diameter and 5.0 mm thick in the direction of layering; and aerating said cylindrically excised drip absorption mat stack in the horizontal direction.

9. A drip absorption mat, for use with a tray configured with a mounting surface on which the food is to be placed, according to claim 1;

wherein said drip absorption mat is sized to be laid on the mounting surface of the tray between the tray and the food.

* * * * *